US011959236B1

(12) United States Patent
Calloway et al.

(10) Patent No.: US 11,959,236 B1
(45) Date of Patent: Apr. 16, 2024

(54) MATERIAL COLLECTION SYSTEM

(71) Applicant: Old Dominion Brush Company, Henrico, VA (US)

(72) Inventors: Britt R. Calloway, Midlothian, VA (US); Andrew Nitchie, Henrico, VA (US); Robert Mayes, Hanover, VA (US); Tim Stumph, Midlothian, VA (US); Chris Turner, Aylett, VA (US)

(73) Assignee: Old Dominion Brush Company, Henrico, VA (US)

( * ) Notice: Subject to any disclaimer, the term of this patent is extended or adjusted under 35 U.S.C. 154(b) by 0 days.

(21) Appl. No.: 17/935,735

(22) Filed: Sep. 27, 2022

(51) Int. Cl.

| | |
|---|---|
| ***E01H 1/08*** | (2006.01) |
| ***A47L 5/22*** | (2006.01) |
| ***A47L 9/24*** | (2006.01) |
| ***A47L 9/28*** | (2006.01) |
| ***E02F 3/88*** | (2006.01) |

(52) U.S. Cl.
CPC ..... *E01H 1/0836* (2013.01); *A47L 5/22* (2013.01); *A47L 9/248* (2013.01); *A47L 9/2842* (2013.01); *A47L 9/2857* (2013.01); *A47L 9/2868* (2013.01); *E01H 2001/0881* (2013.01); *E02F 3/8816* (2013.01)

(58) Field of Classification Search
CPC ..... A47L 5/22; A47L 9/248; A47L 9/2842; A47L 9/2857; A47L 9/2868; E01H 1/0836; E01H 2001/0881; E02F 3/8816
See application file for complete search history.

(56) References Cited

U.S. PATENT DOCUMENTS 4,935,984 A * 6/1990 Bryant ..... E03F 7/10 15/340.1
11,035,089 B1 * 6/2021 Calloway ..... E01H 1/0836

* cited by examiner

*Primary Examiner* — Eric J Rosen
*Assistant Examiner* — Christopher Soto
(74) *Attorney, Agent, or Firm* — Sterne, Kessler, Goldstein & Fox P.L.L.C.

(57) ABSTRACT

A material collection system is provided. The system can include a vacuum generator having a fan to develop an airflow and draw material into a conduit. The system can also include a transmission, a power source to selectively power at least one of the vacuum generator and the transmission, a variable power divider to divide a power output from the power source to the transmission and the vacuum generator, and a control system to control the variable power divider in a first mode and a second mode.

14 Claims, 15 Drawing Sheets

| Fan RPM | 0 | 1200 | 1600 | 2000 | 2400 | 2600 |
|---|---|---|---|---|---|---|
| Engine RPM | 1000 or idle | 1400 | 1400 | 1800 | 2000 | 2000 |

FIG. 10

MATERIAL COLLECTION SYSTEM

FIELD

The present disclosure generally relates to systems and methods for power management. In particular, aspects relate to power management of material collection systems.

BACKGROUND

Material collection systems can be used to intake a variety of debris for removal and disposal. Some material collection systems can include additional functionality such as cleaning, sweeping, and excavation. Some material collection systems can be mounted onto a vehicle or a trailer pulled by a vehicle, others can be mounted onto other mobile equipment such as tracked or rail-bound vehicles. Material collection systems can utilize a number of mechanisms for intaking debris. For example, some material collection systems can use a vacuum generator to intake debris. An operator can manually control the power of the vacuum generator (e.g., manually change the speed of the vacuum generator).

BRIEF SUMMARY

Some aspects of the invention provide a material collection system including a vacuum generator, a transmission, a power source, a variable power divider, and a control system. The vacuum generator can include a fan to develop an airflow and draw material into a material inlet of a conduit. The transmission can control a drive of the material collection system. The power source can selectively power at least one of the vacuum generator and the transmission. The variable power divider can engage with the power source and the transmission and selectively engage with the vacuum generator, such that the variable power divider divides an output of the power source into a first input to the transmission to control a speed of the transmission and second input to the vacuum generator to control a speed of the fan. The control system can control the output of the power source, the first input, and the second input based on a first mode in which the variable power divider is disengaged from the vacuum generator and a second mode in which the variable power divider is engaged with the vacuum generator. The control system can also relationally controls the output speed of the power source and the second input in the second mode.

In some aspects, the material collection system can also include a boom supporting the conduit. The boom can be moveable between a stowed position and an operational position. In the first mode, the boom is in the stowed position.

In some aspects, approximately all of the output of the power source is transmitted to the first input in the first mode.

In some aspects, at least a portion of the output of the power source is transmitted to the second input in the second mode.

In some aspects, the material collection system can also include a throttle to receive a throttle input and control the output of the power source in the first mode and the second mode.

In some aspects, the throttle input can include a threshold. In the second mode, the control system can control the output of the power source to a set point when the throttle input is less than the threshold.

In some aspects, the threshold is approximately 60% engagement of the throttle input.

In some aspects, the set point is determined based on a speed of the fan.

In some aspects, the set point is approximately 1400 RPM when the speed of the fan is approximately 1200 RPM to approximately 1600 RPM.

In some aspects, the set point is approximately 1800 RPM when the speed of the fan is approximately 2000 RPM.

In some aspects, the set point is an idle speed when the speed of the fan is approximately a minimum speed.

In some aspects, the idle speed is approximately 1000 RPM.

In some aspects, the throttle input controls the output of the power source to a maximum speed when the throttle input is greater than the threshold.

In some aspects, the maximum speed is approximately 2000 RPM

In some aspects, the material collection system also includes a control input. The control system can control the first mode and the second mode based on the control input.

In some aspects, the control input comprises a switch on a joystick.

Some aspects of the invention provide a material collection system including a container, a conduit movable from a stowed position to an operating position, a vacuum generator, a transmission to control a drive of the material collection system, a power source to power the vacuum generator and the transmission, and a chassis. The conduit can include a material inlet. The vacuum generator can include a fan to develop an airflow and draw material into the material inlet. The container can form a first width. The conduit can form a second width when in the stowed position. The chassis can form an overall width, the overall width includes the first width and the second width.

In some aspects, the overall width is less than approximately 102 inches.

In some aspects, a centerline of the container is offset from a centerline of the material collection system.

In some aspects, the container is offset by approximately 5 inches.

Some aspects of the invention provide a method for operating a material collection system including selectively powering at least one of a transmission and a vacuum generator using a power source, operating the fan of the vacuum generator at a first speed, receiving an electronic signal indicating the material collection system is in a first mode in which a vehicle of the material collection system is moving at a travel speed, and reducing the speed of the vacuum generator from the first speed based on the first mode. The vacuum generator can include a fan to develop an airflow and draw material into a material inlet of a conduit.

In some aspects, the method also includes receiving an electronic signal indicating the material collection system is in a second mode in which the vehicle is moving at less than the travel speed, and increasing the speed of the vacuum generator to the first speed.

BRIEF DESCRIPTION OF THE DRAWINGS/FIGURES

The accompanying drawings, which are incorporated herein and form part of the specification, illustrate aspects and, together with the description, further serve to explain the principles of the aspects and to enable a person skilled in the relevant art(s) to make and use the aspects.

FIG. 10 is a chart of relational speed control of a vacuum generator and a power source via a variable power divider according to various aspects.

Figure 1:
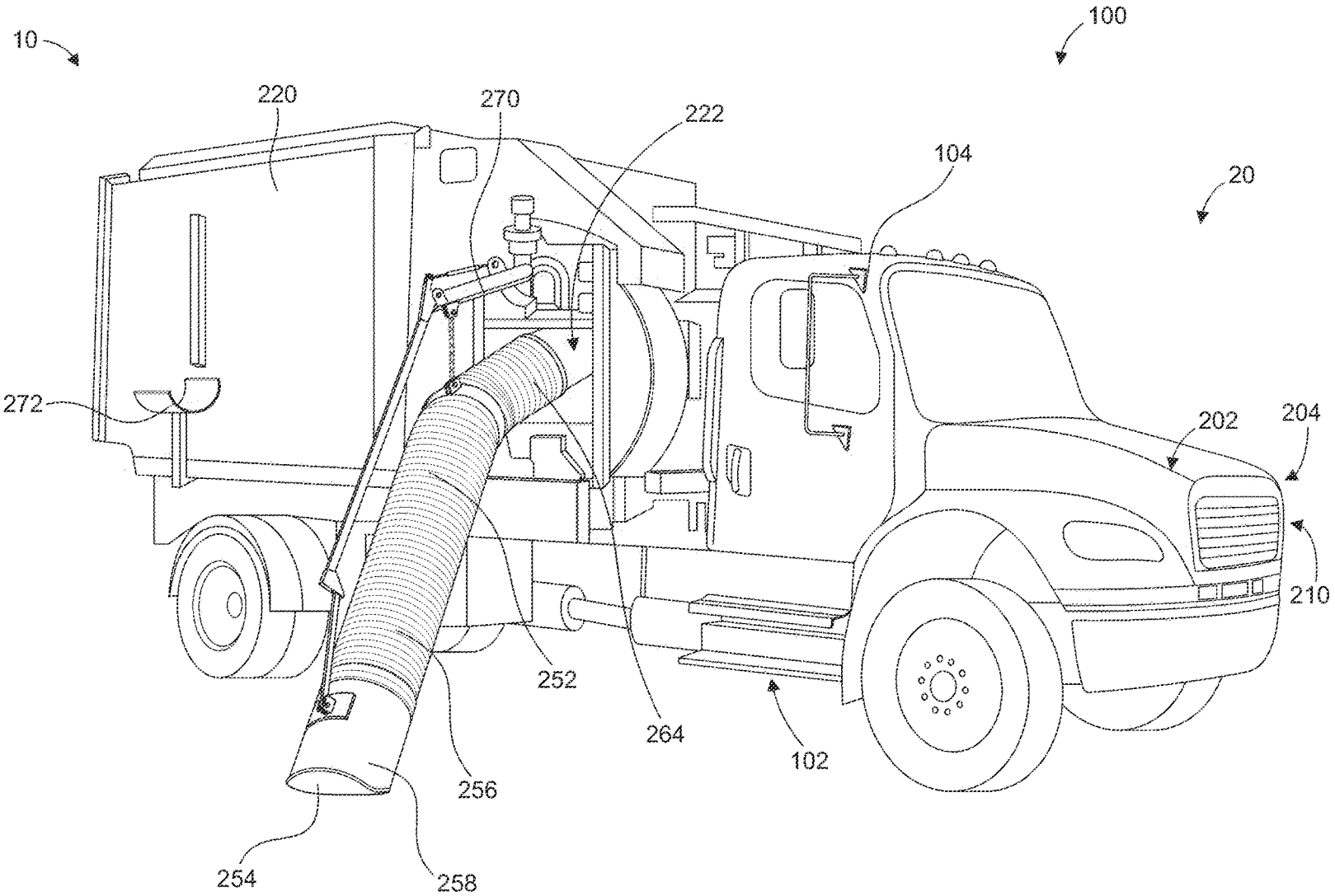
FIG. 1 is a perspective view of a material collection system according to various aspects.

The features and advantages of the aspects will become more apparent from the detail description set forth below when taken in conjunction with the drawings, in which like reference characters identify corresponding elements throughout. In the drawings like reference numbers generally indicate identical, functionally similar, and/or structurally similar elements.

DETAILED DESCRIPTION

Aspects of the present disclosure are described in detail with reference to aspects thereof as illustrated in the accompanying drawings. References to "one aspect," "an aspect," "an exemplary aspect," etc., indicate that the aspect described can include a particular feature, structure, or characteristic, but every aspect can not necessarily include the particular feature, structure, or characteristic. Moreover, such phrases are not necessarily referring to the same aspect. Further, when a particular feature, structure, or characteristic is described in connection with an aspect, it is submitted that it is within the knowledge of one skilled in the art to affect such feature, structure, or characteristic in connection with other aspects whether or not explicitly described.

The following examples are illustrative, but not limiting, of the present aspects. Other suitable modifications and adaptations of the variety of conditions and parameters normally encountered in the field, and which would be apparent to those skilled in the art, are within the spirit and scope of the disclosure.

Material collection systems can be used to intake a variety of materials, such as debris. Material collection systems can include components such as a conduit, e.g., a hose, supported by a boom. The boom can be connected to a vehicle on one end. The conduit can be used to direct airflow generated by a vacuum generator and have an intake end to engage with a pickup site for material collection, such as via a nozzle. A material collection system can also include a boom control system to allow flexibility of material intake. In this example, an operator can move the boom, and therefore the conduit, around the longitudinal, lateral, and/or vertical axes using the control system.

Material collection systems can be driven using a variety of power sources. For example, a material collection system can include a vehicle having an engine and drivetrain, such as a truck. The engine can propel the vehicle forward. Components of the material collection systems can be mounted onto such a vehicle and can be driven by high power and/or an auxiliary power source. An auxiliary engine, for example, can supplement the engine to support the high power consumption of material collection.

However, an auxiliary power source can be bulky and heavy, can limit free space on the vehicle, and can add to the vehicle's overall weight. A heavy duty vehicle (e.g., a truck or vehicle exceeding approximately 26,000 pounds (lbs.)) can therefore be required to transport the material collection system to a pickup site and power the material collection system. Heavy duty vehicles can have a gross vehicle weight rating (GVWR) of over 26,000 lbs., in part, from the inclusion of an auxiliary engine. Indeed, traditional vehicles supporting material collection systems can have a gross vehicle weight rating of 33,000 lbs. to 35,000 lbs. Accordingly, the auxiliary engine and supporting chassis to handle large payload can increase the total curb weight of material collection vehicles.

Heavy duty vehicles can pose other challenges as well. For example, navigating heavy duty vehicles through narrow roads and access to constrained pickup sites can be dangerous and difficult. In addition, a commercial driver's license is typically required to operate heavy duty vehicles (e.g., vehicles having a GVWR over 26,000 lbs.). Accordingly, qualified personnel who require training are needed to operate heavy duty vehicles.

Compact material collection systems are desirable to reduce the size and weight of the overall vehicle. Reducing the size and weight can allow operators without a commercial driver's license to operate material collection systems and realize savings in energy usage and environmental impact. To reduce the size and weight of the vehicle, the auxiliary engine can be removed, such that material collection components (e.g., vacuum generator and pneumatic pumps) and the forward movement of the vehicle are all powered by the same engine. However, not all material collection system components are required to function at the same time. For example, material collection systems, such as a vacuum generator, do not need to be operational while the vehicle is traveling between material collection sites at a travel speed (e.g., greater than 5 miles per hour (mph)). Similarly, limited power is needed to propel the vehicle forward at a work speed (e.g., less than 5 mph) during material collection. Energy waste can aggravate issues related to fuel consumption, such as associated costs and the environmental impact. Additionally, simply including a higher power engine can result in a larger size and weight, precluding having a compact material collection system.

Systems and methods described herein provide a material collection system having a single engine and a power management system to overcome the deficiencies described above. The power source to both propel the vehicle and power the material collection system can be a single engine, such that auxiliary power sources are not utilized. The power management system can selectively direct output from the engine to particular components of the material collection system according to usage requirements under various working conditions.

Components of the material collection system can require different power inputs under different conditions. For example, when the power to propel the vehicle forward through a transmission is at a highest level (e.g. the material collection system is traveling at a travel speed (e.g., greater than 5 mph)), the power required at the vacuum generator can be at a lowest level because the material collection system does not function to intake material. Alternatively, when the power for the vacuum generator is at a highest level (e.g. the material collection system is working to intake material), the power required to propel the vehicle forward can be at a lowest level because the vehicle can be traveling at low speed (e.g. less than or equal to 5 mph). In other words, the power consumption required by different components of the material collection system can complement each under different conditions of the material collection system.

Accordingly, by selectively distributing the power output from an engine to different components of the material collection system based on specific usage, power usage efficiency of the material collection system can be maximized, and power output waste can be minimized. In addition, a high power output engine having a larger size and weight is not required to accommodate the power requirement of selectively powering the vacuum generator and/or additional components, such as pneumatic pumps. Consequently, the material collection system can be compact, lightweight, and/or provide free space while maintaining sufficient power output to support the functioning of the entire material collection system.

In some aspects, the power management system can include a variable power divider. The variable power divider can include a gear assembly that can engage with the engine and the transmission and can selectively engage with the vacuum generator. In this way, the variable power divider can divide a power output from the engine between the transmission and the vacuum generator. A gear ratio of the gear assembly can be adjusted to determine the amount of power distributed to the transmission and the vacuum generator.

In some aspects, the material collection system can include a control system to control the power management system based on different operating conditions of the material collection system. In some aspects, the control system can control the power management system based on one or more modes. For example, in some aspects, the control system can control the power management system based on a first mode. The first mode can be a travel mode in which the vacuum generator can idle and the vehicle can travel at speeds greater than 5 mph. In some aspects, the control system can control the power management system based on a second mode. The second mode can be a collection mode in which the vacuum generator can develop airflow to intake material and the vehicle can travel at speeds less than or equal to 5 mph. In some aspects, the control system can control the power management system based on additional or alternative modes, such as a dump mode. The control system can control the power management system among the one or more modes based on a throttle input of the engine.

In some aspects, the variable power divider can selectively engage and disengage the vacuum generator while the power output from the engine is transmitted to the transmission for forward or rearward travel through a drivetrain. This can facilitate dividing power to the vacuum generator without bringing the vehicle to a stop and/or engaging a parking break. Switching power distribution in this manner can facilitate smooth and efficient operation. A control input to the variable power divider can be integrated with other traditional vehicle control commands, such as a steering wheel, a joystick, and/or a foot pedal. This can minimize the disruption to a user's operation of the material collection system and can facilitate on the fly engagement.

In some aspects, the lighter weight of the material collection system having a single engine can allow for flexibility in organizing components of the material collection system. By having one engine, additional space can be created. For example, in some aspects, a container to store collected material can be disposed offset from a center of the vehicle axel, thus creating additional space for the conduit and the boom within the width of the vehicle axel. This can reduce the total width of the vehicle and achieve a compact design.

Figure 2:
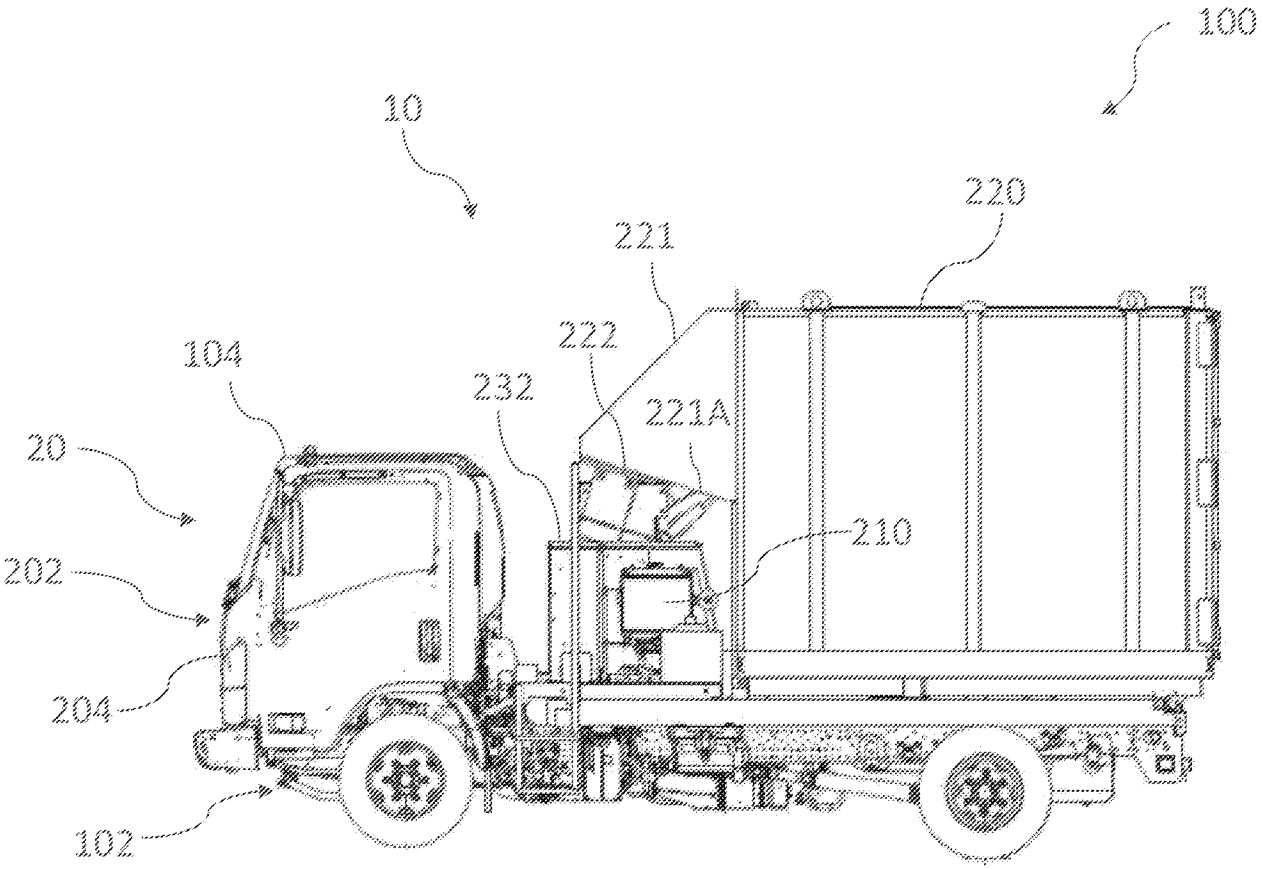
FIG. 2 is a side view of a material collection system according to various aspects.
Figure 3:
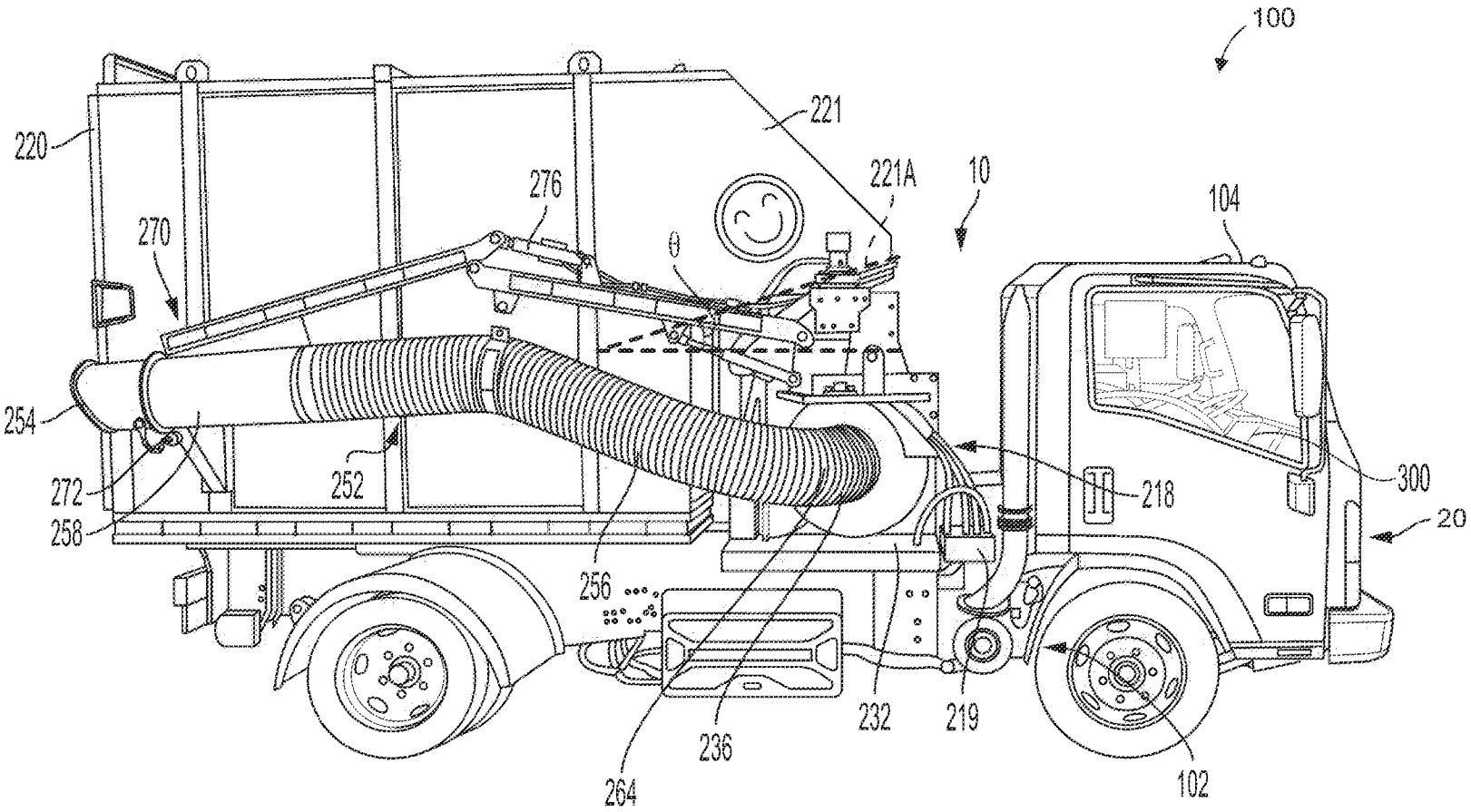
FIG. 3 is a side view of a material collection system according to various aspects.

In some aspects, the GVWR of the entire material collection system can be less than or equal to 26,000 lbs., thereby allowing drivers without commercial driver's license to legally operate the material collection system. The maximum width of the material collection system can be less than or equal to approximately 102 inches, which is the maximum width limit for commercial motor vehicles permitted by National Highway Traffic Safety Administration without being restricted as an "oversized load." Aspects will now be described with reference to the figures. With reference to FIGS. 1-3, in some aspects, a material collection system 100 can include material collection components 10 and a vehicle 20, which can be, for example, a truck. Vehicle 20 can include a chassis 102 and a cab 104 mounted on chassis 102. Material collection components 10 can be mounted on vehicle 20. In some aspects, material collection system 100 can have a GVWR in a range of approximately 25,000 lbs to approximately 35,000 lbs, such as approximately 27,000 lbs to approximately 33,000 lbs, or such as approximately 29,000 lbs to approximately 31,000 lbs. In some embodiments, material collection system 100 can have an unloaded weight (e.g. curb weight) in a range of approximately 15,000 lbs to approximately lbs, such as approximately 18,000 lbs to approximately 22,000 lbs, or such as approximately 19,500 lbs. In some aspects, material collection system 100 can include a single engine that both powers the material collection system 100 drivetrain and powers a vacuum generator. Material collection system 100 can include a power management system to control power to the drivetrain and/or vacuum generator.

With reference to FIG. 1, in some aspects, material collection components 10 and cab 104 can be mounted on chassis 102. An operator can reside in cab 104 and drive vehicle to a material pickup site. In some aspects, the operator can reside in cab 104 during a material collection operation. In another aspect, the operator and/or a second operator can manually control material collection components 10. For example, the operator can reside in cab 104 and a second operator can be external to the cab.

Vehicle 20 can include an engine 204. In some aspects, engine 204 can be disposed in front of cab 104, as shown in FIG. 1. In some aspects, engine 204 can be disposed under cab 104, providing a more compact orientation, as shown in FIG. 2. In some aspects, engine 204 can be an internal combustion engine. In some aspects, engine 204 can be an electric motor powered by a battery hybrid or battery system. Engine 204 can provide the motive power to propel vehicle 20 forward or backward, and at the same time, engine 204 can provide power to material collection components 10, such that material collection system 100 is a single engine unit. For example, engine 204 can power vehicle 20 though transmission and drivetrain and can power vacuum generator 232 using a drive shaft, a power takeoff, a hydraulic system, or indirectly via a drive belt system. In some aspects, engine 204 can directly power material collection components 10 such that no intermediate power source (e.g., an auxiliary power source) is required.

In some aspects, an auxiliary power source 210 can be included to power material collection components 10, for example, in a hybrid configuration where engine 204 charges a battery to supply energy to auxiliary power source 210. Auxiliary power source 210 can facilitate powering vacuum generator 232 or other material collection components 10.

In some aspects, engine 204 can provide adequate power to vacuum generator 232. In some aspects, engine 204 can provide a power in a range of approximately 200 horsepower to approximately 320 horsepower, such as in a range of approximately 240 horsepower to approximately 280 horsepower, or such as approximately 260 horsepower. In some aspects, up to approximately 60% of engine 204 power can be provided to vacuum generator 232, such as approximately 0% to approximately 60%, such as approximately 0% to approximately 50%, or such as approximately 0% to approximately 40%. For example, in some aspects, when engine 204 provides 260 horsepower, the power provided to vacuum generator 232 can be approximately 150 horsepower (e.g. approximately 58% of engine 204 power), such that the volumetric flow rate capacity of vacuum generator 232 can be in a range of approximately 15,000 CFM and approximately 25,000 CFM.

Material collection system 100 can include one or more material collection components 10 for material collection. In some aspects, as shown in FIGS. 2-3, material collection components 10 can include a vacuum generator 232, a conduit 252, and/or a boom 270. These and/or other components can be powered by power source 202. In some aspects, conduit 252 can be manually moved and positioned for material collection. In some aspects, vacuum generator 232 can be in fluid communication with conduit 252 supported by a boom 270. For example, conduit 252 can be removably coupled to an inlet port 236 of vacuum generator 232. In some aspects, vacuum generator 232 can generate an airflow for drawing material through an intake end 258 of conduit 252.

In some aspects, vacuum generator 232 and conduit 252 can be in fluid communication with a container 220 such that container 220 receives material collected through conduit 252. In some aspects, material can be moved through inlet 222 of container 220. In some aspects, container can have an inlet 222 to facilitate intake of material. Material can be moved through conduit 252 to an inlet 222 of container 220.

In some aspects, as shown in FIG. 2, for example, container 220 can include a nose extension 221 disposed at the front end of container 220. In some aspects, nose extension 221 can extend across the entire width of container 220. In some aspects, nose extension 221 can be shaped as a truncated-pyramid. Material collection components 10 (e.g., vacuum generator 232) can be disposed below nose extension 221. By extending above other material collection components 10, nose extension 221 can increase the storage capacity of container 220, while still allowing material collection system 100 to have a compact design. For example, nose extension 221 can increase the storage capacity of container 220 by approximately two cubic yards. In some aspects, nose extension 221 can increase the payload capacity by up to 15% and can provide a more uniform loading between the two axles of vehicle 20.

With reference to FIGS. 2-3, in some aspects, nose extension 221 can include a bottom end 221A projecting from the front end of container 220, such as for example, at an approximate midpoint along the height of container 220. In some aspects, bottom end 221A can include inlet 222 and can define an opening into container 220. Bottom end 221A of nose extension 221 can be directly connected to outlet port 238 of vacuum generator 232 to receive collected material. The shape of nose extension 221 can increase the storage capacity of container 220. For example, as shown in FIG. 3, bottom end 221A of nose extension 221 can be inclined at an angle $\Theta$ with respect to a plane extending parallel to horizontal. In an aspect, angle $\Theta$ can be in a range of approximately 5 degrees to approximately 40 degrees, such as approximately 10 degrees to approximately 30 degrees.

Material collection components 10 can be disposed around container 220, which can store material collected and/or additional components. For example, in some aspects, vacuum generator 232 can be disposed proximate to a front end of container 220 and behind cab 104.

In some aspects, container 220 can be sized to permit sufficient collection of material and debris, but to prevent an operator from exceeding a gross vehicle weight of 26,000 lbs. In some aspects, container 220 can define a storage volume in a range of approximately 18 cubic yards to approximately 26 cubic yards, such as approximately 20 cubic yards to approximately 24 cubic yards, or such as approximately 22 cubic yards to approximately 23 cubic yards. By defining a storage volume in a range of approximately 18 cubic yards to approximately 26 cubic yards, container 220 can include outer dimensions (e.g., width, height, length) that allow the center of gravity of material collection system 100 to be placed optimally between a vehicle axle. Furthermore, by defining a storage volume in a range of approximately 18 cubic yards to approximately 26 cubic yards, container 220 can include outer dimensions that allow vehicle 20 to have a shorter wheelbase for a tight turn radius. For example, container 220 can include a length in a range of approximately 16 feet to approximately 20 feet, such as a length of approximately 18 feet. In addition, container 220 can include a width in a range of approximately 6 feet to approximately 8 feet, such as a width of approximately 7 feet. In some aspects, container 220 can include a width of 7.1 feet (e.g., 85.41 inches) and a length of 18.15 feet (e.g., 217.8 inches), which renders a storage volume of 22.6 cubic yards. In some aspects, the outer dimensions of container 220 can render an overall width of chassis 102 (FIG. 1) being approximately 102 inches.

Figure 4:
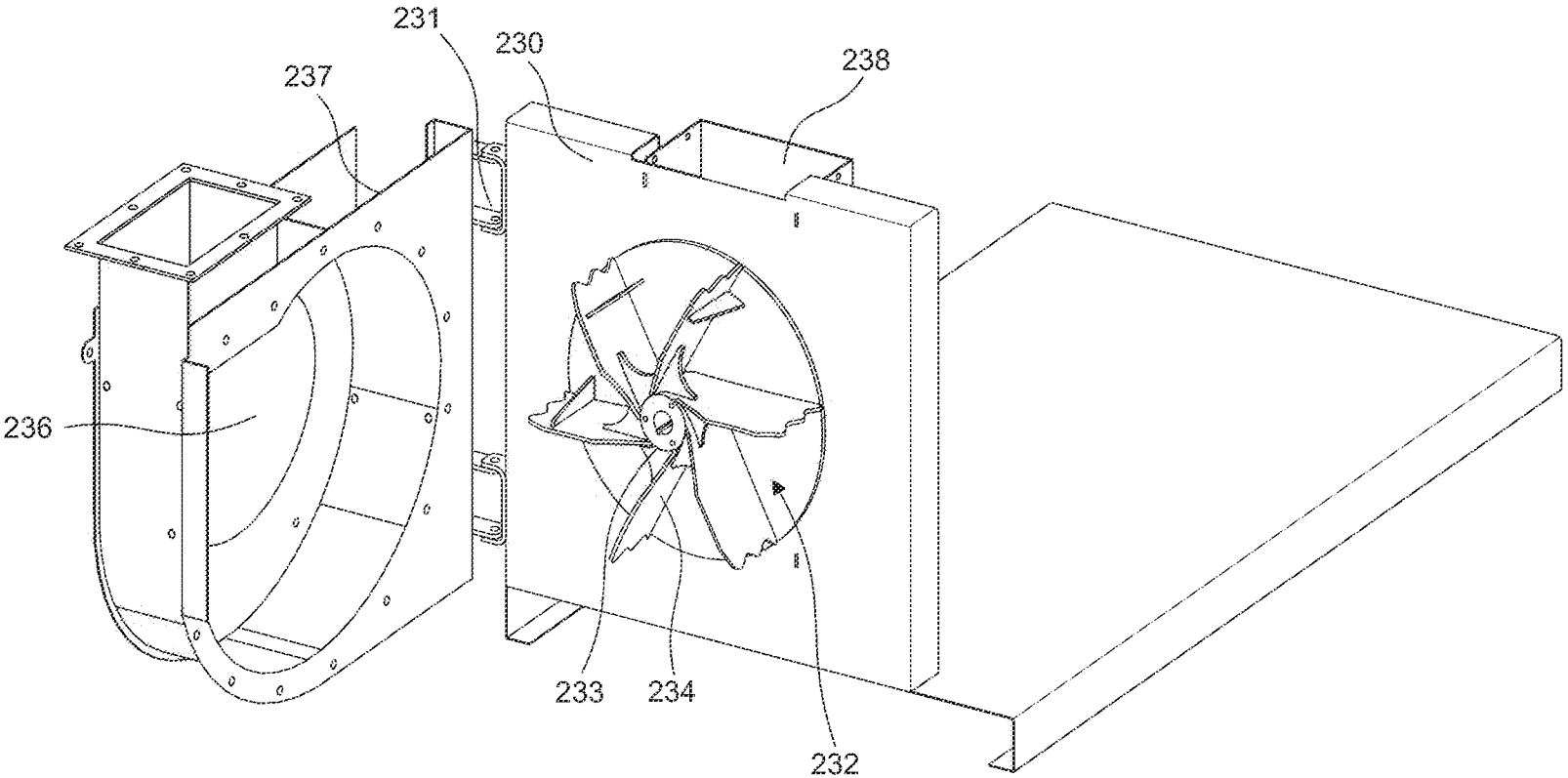
FIG. 4 is a perspective view of a vacuum generator according to various aspects.

Vacuum generator 232 is shown, for example, in FIG. 4. In some aspects, the airflow developed by vacuum generator 232 can retrieve material from the pickup site. For example, the airflow generated by vacuum generator 232 can create a substantial air pressure differential between conduit 252 and the ambient air of the area surrounding intake end 258 of conduit 252 to draw material into conduit 252. In some aspects, material disposed in the pickup site can be drawn by the airflow through intake end 258 and travel through conduit 252 and vacuum generator 232. In some aspects, container 220 (FIG. 3) can further include an outlet for exhausting the airflow into the ambient environment. In other aspects, airflow can be recirculated to develop a regenerative vacuum in vacuum generator 232. In some aspects, material can be collected in container 220.

In some aspects, vacuum generator 232 can include a fan 233, such as centrifugal fan or an axial fan. In some aspects, fan 233 can develop an airflow and draw material into intake end 258 of conduit 252. In some aspects, fan 233 can have a plurality of blades 234 that can rotate when powered to develop a sub-atmospheric pressure airflow. Blades 234 can also break incoming material into smaller pieces as the material passes through blades 234. In some aspects, fan 233 can include a diameter in a range of approximately 30 inches to approximately 34 inches, such as approximately 32 inches. In some aspects, fan 233 of vacuum generator 232 can generate a volumetric flow rate in a range of approximately 13,000 CFM to approximately 27,000 CFM, such as approximately 15,000 CFM to approximately 25,000 CFM, or such as approximately 17,000 CFM to approximately 23,000 CFM.

In some aspects, vacuum generator 232 can include a housing 230 partially enclosing fan 233. In some aspects, housing 230 can include the outlet port 238 connected to container 220 via duct 224. In some aspects, housing 230 can include a frame 237 to accommodate inlet port 236 for receiving an outlet end 264 of conduit 252. In some aspects, housing 230 can be pivotably coupled to frame 237 by a hinge 231 such that housing 230 can be pivoted away from inlet port 236 to provide access to fan 233 for servicing.

With reference to FIGS. 1-4, in some aspects, conduit 252 can extend away from vacuum generator 232 and terminate at intake end 258. In some aspects, conduit 252 can comprise a flexible material (e.g., elastic material) so that the conduit 252 can be bent or flexed to adjust the position of intake end 258 to a variety of positions around the pickup site of vehicle 20. In some aspects, conduit 252 can include an interior wall 254 and/or an exterior wall 256. In some aspects, interior wall 254 can support the airflow through conduit 252. For example, interior wall 254 can be smooth and free of obstructions. In some aspects, one or more sections of interior wall 254 and/or exterior wall 256 can include corrugated plastic. In some aspects, interior wall 254 and/or exterior wall 256 can include plastics, metals, composites, or a combination thereof.

In some aspects, boom 270 can lift and support conduit 252. In some aspects, boom 270 can be in a rack 272 such that boom 270 can be in a stowed position. In the stowed position, boom 270 can be substantially parallel to chassis 102. In some aspects, conduit 252 can extend outward from vehicle 20 such that boom 270 can be in an operational position to position conduit 252 to intake material.

In some aspects, the amount of conduit 252 that extends from vehicle 20 is adjustable such that conduit 252 can extend from vehicle 20 or retract towards vehicle 20, depending on the pickup site. In some aspects, the extension of conduit 252 can be adjusted before or during a material collection operation. In some aspects, conduit 252 can include a length in a range of approximately 6 feet to approximately 12 feet, such that the length of conduit 252 provides a sufficient range of reach to collect material around vehicle 20, while minimizing weight. In some aspects, conduit 252 can include a diameter in a range of approximately 10 inches to approximately 16 inches, such that the power source 202 can operate effectively with less power capacity to generate sufficient suction force within conduit 252 to collect material.

In some aspects, boom 270 can be moved (e.g., by one or more hydraulic actuators) from a lower position (e.g., a position substantially parallel to chassis 102), as shown in FIG. 3, to a higher position (e.g., a position at an angle relative to chassis 102), as shown in FIG. 1. In an aspect, the lower position can be stowed position and the higher position can be operational position. In other aspects, boom 270 can control movement of conduit 252 (e.g., by one or more hydraulic actuators) such that the position of intake end 248 can be adjusted in longitudinal direction, a lateral direction, and/or a vertical direction. In some aspects, the combination of moveable boom 270 and conduit 252 can provide flexible positioning of intake end 248 at pickup sites.

In some aspects, material collection system 100 can pick up and remove material from a pickup site of various composition and/or sizes. For example, the material can be natural debris (e.g., leaves, branches, or dirt), recyclables (e.g., plastics, metals, or papers), and/or waste (e.g., food waste or non-recyclables). Debris, such as natural debris, can further include particulate matter (e.g., matter suspended in air). In some aspects, conduit 252 and container 220 can intake and contain a plurality of different types of materials, respectively. Intake end 258 can include a plurality of attachments to enable intake of a plurality of materials. For example, intake end 258 can include a cutting attachment to cut, for example, wet leaves and/or plastic waste so that the material can be collected by material collection system 100. Thus, while the cross-sectional area of conduit 252 and intake end 248 can be fixed in some aspects, material collection system 100 can receive larger sized material and material of different shapes.

In other aspects, intake end 258 can include material for engagement with a plurality of materials. For example, material can include rigid materials such as rocks which can damage material collection system 100. Intake end 258 can contain metal (e.g., steel) such that intake end 258 retains its structure when engaging with certain materials. This aspect can be included for certain applications, such as excavation (e.g., breakage of material for collection and disposal). In some aspects, a broom attachment to sweep a surface can attach to intake end 258 and/or another part of material collection system 100. The broom attachment can be used for collection of material for intake. In some aspects, airflow can be recirculated within the broom attachment to contain particulate matter. In some aspects, intake end 258 of conduit 252 can include a rigid nozzle integrated with boom 270. In some aspects, the rigid nozzle of intake end 258 can be welded to boom 270. The rigid nozzle of intake end 258 can facilitate precise control over the motion of intake end 258 in restrictive environments.

In some aspects, material collection system 100 can include a hydraulic system 218 as shown in FIG. 3. Hydraulic system 218 can be controlled via a single engine and a power management system, as described herein. In some aspects, hydraulic system 218 can be operatively connected to boom 270 to adjust the position of conduit 252. In some aspects, hydraulic system 218 can include a hydraulic valve block 219 that includes a set of ports and valves to control the pressure of the hydraulic fluid and regulate the direction of the hydraulic fluid flow in hydraulic system 218. In some aspects, hydraulic system 218 can include one or more boom actuators 276, such as for example, a hydraulic cylinder with a reciprocating piston rod, to move boom 270 such that the position of conduit 252 can be adjusted in a lateral direction, a longitudinal direction, and/or a vertical direction.

In some aspects, particulate matter such as leaf dust can require additional processing for containment in container 220. Containment of particulate matter can prevent the particulate matter from exhausting and returning to the environment. Exhausting particulate matter can be undesirable as it can return material to the environment and can impair nearby operators (e.g., particulates can be inhaled by operators or enter an operator's eyes). Leaf material, for example, can include dry leaves and/or wet leaves. Leaves, because of their weight, can be directed downward through container 220. However, dry leaves can include leaf dust which cannot be similarly directed downward. In some aspects, material collection system 100 can further include a water system, such as a water tank, a water pump, and/or a water line. In some aspects, container 220 can receive water. In some aspects, water can remove the particulate matter from the airflow such that it can be directed downward by the added weight. In some aspects, liquid from wet material can be discharged. In other aspects, liquid can be redirected through the water system for reuse.

As discussed above with reference to FIG. 1, engine 204 can provide power to propel vehicle 20, as well as to power material collection components 10, for example vacuum generator 232. Accordingly, engine 204 can be the only power source that both propels vehicle 20 and powers vacuum generator 232. In this way, material collection system 100 can be a single engine unit. A variable power divider 290 can be included to facilitate supplying power to both vehicle 20 and material collection components 10 via the single engine unit. With reference to FIG. variable power divider 290 can selectively distribute power output of engine 204 to power transmission 208 and vacuum generator 232. In an aspect, variable power divider 290 can power transmission 208 to control a drive of material collection system 100 and can power vacuum generator 232 to control a speed of fan 233.

Power needs of transmission 208 and vacuum generator 232 can be variable. For example, the power required by transmission 208 to control the drive of material collection system 100 can be at a higher level when material collection system 100 is traveling at a travel speed (e.g., greater than 5 mph). During travel, the power required by vacuum generator 232 can be at a lower level because material collection system 100 does not function to intake material when traveling at a travel speed. Alternatively, the power required by vacuum generator 232 to control the speed of fan 233 can be at a higher level, when material collection system 100 is working to intake material. At the same time, the power required by transmission 208 to control the drive of material collection system 100 can be at a lower level because material collection system 100 travels at lower speed (e.g. <=5 mph), during material intake. In other words, the power consumption needs of different components of material collection system 100 can offset each other under varying operating conditions. Accordingly, variable power divider 290 can facilitate distributing power output of engine 204 to power at least one of transmission 208 and vacuum generator 232 based on actual power needs, thereby maximizing energy use efficiency and without increasing the total output of engine 204. Engine 204 can then sufficiently source the power requirement of material collection system 100.

Figure 5:
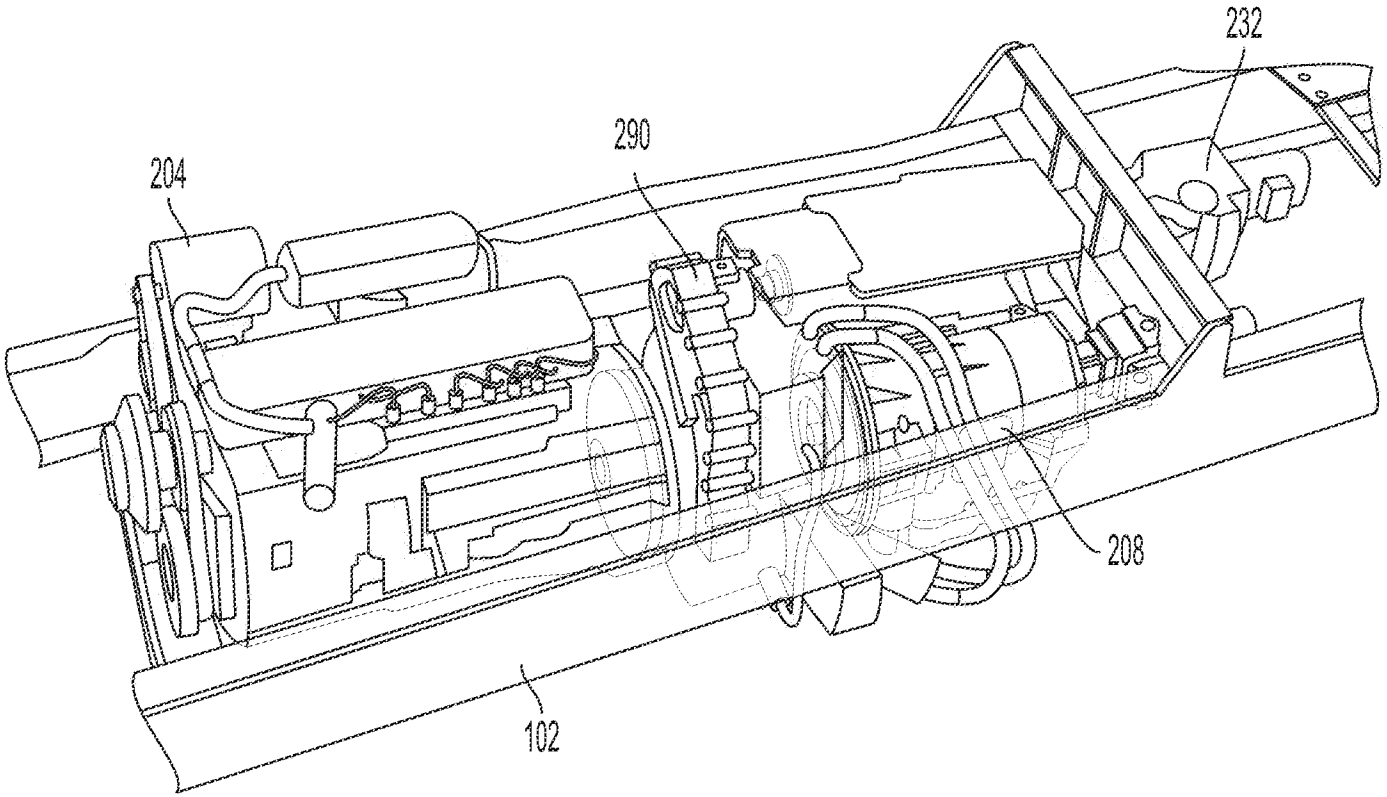
FIG. 5 is a perspective view of a power system with a variable power divider according to various aspects.
Figure 6:
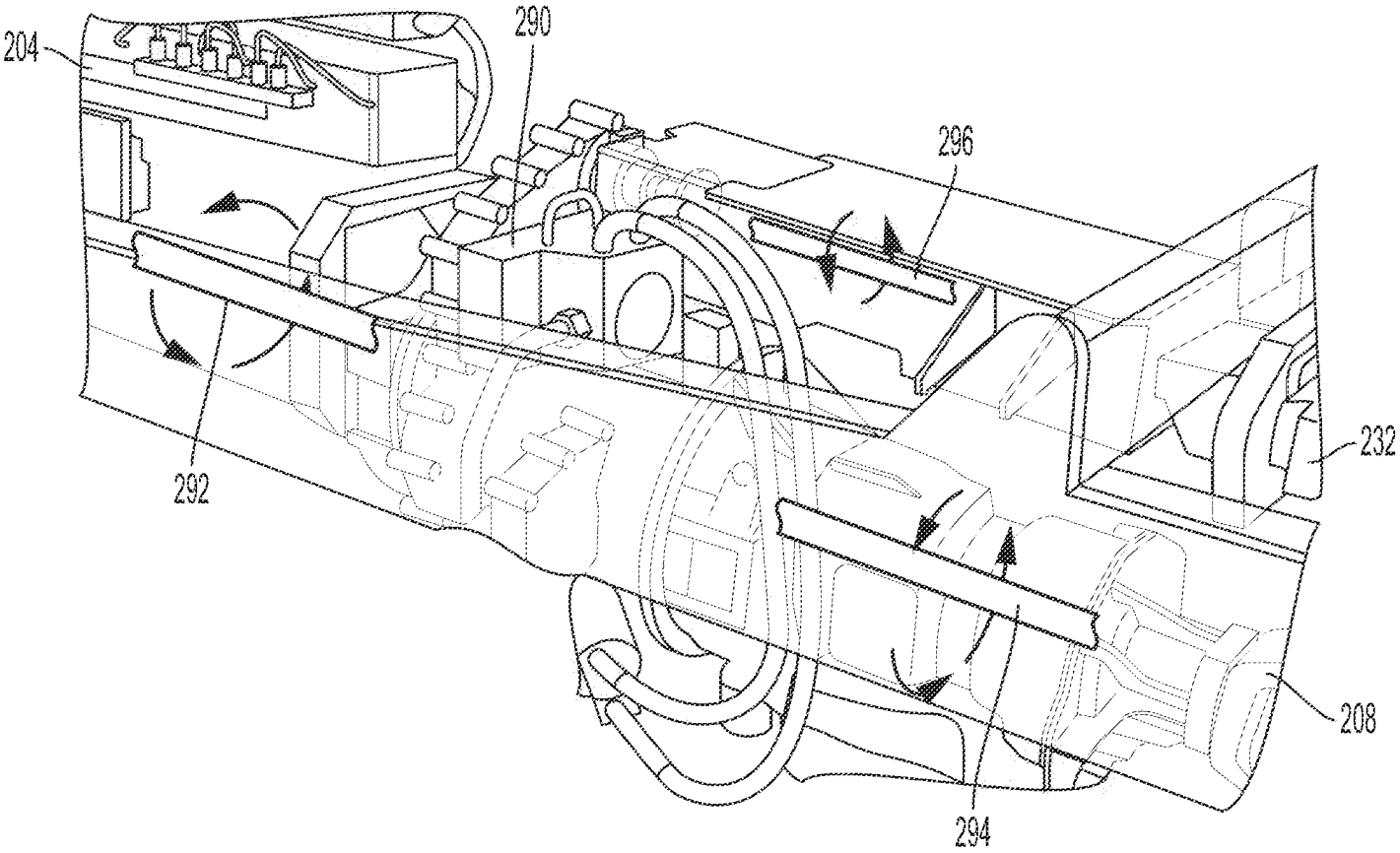
FIG. 6 is a perspective view of a variable power divider according to various aspects.

In some aspects, variable power divider 290 can be disposed on chassis 102 (FIG. 1). As shown in FIGS. 5-6, in some aspects, variable power divider 290 can be intermediate to engine 204 and transmission 208. Variable power divider 290 can also be intermediate to engine 204 and vacuum generator 232. In this way, variable power divider 290 can be engaged with engine 204 and transmission 208 and can selectively engage with vacuum generator 232. A power output 292 from engine 204 can be divided by variable power divider 290 into a first power input 294 to transmission 208 to control a speed of transmission 208 and a second power input 296 to vacuum generator 232 to control a speed of fan 233. Variable power divider 290 can be disengaged from vacuum generator 232 such that power output 292 is transmitted solely to power input 294. Variable power divider 290 can selectively engage with vacuum generator 232 such that power output 292 is transmitted to power output 292 and power input 296. In this way, power output from engine 204 can be divided between transmission 208 and vacuum generator 232. In some aspects, power output 292 from engine 204 can be further divided to hydraulic system 218 (FIG. 3) of material collection system 100 to power various actuators and pumps.

Figure 7:
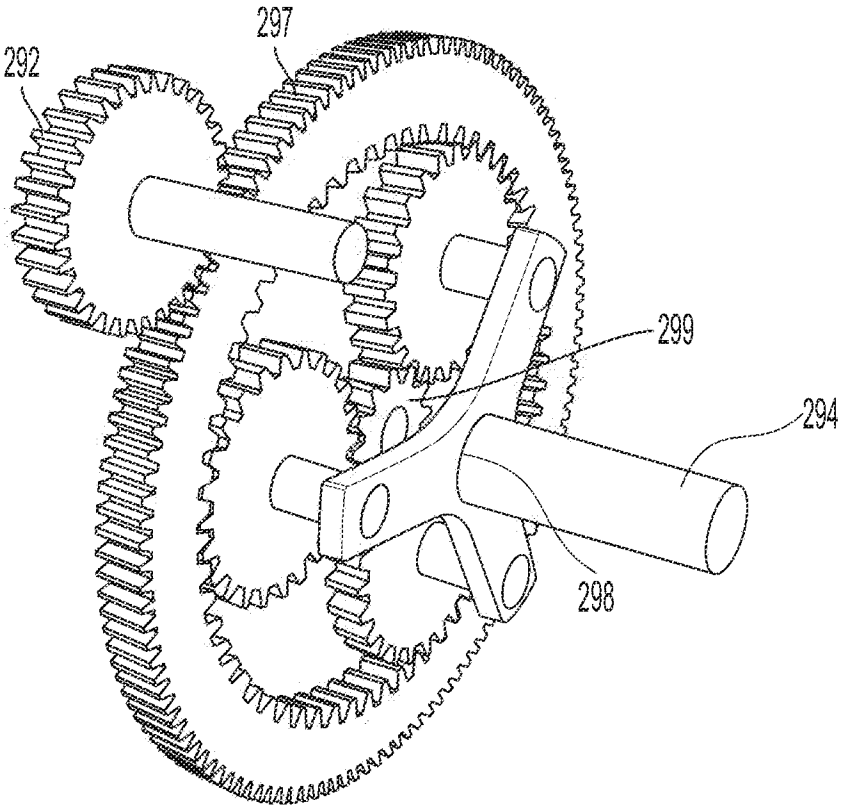
FIG. 7 is a perspective view of a gear assembly of a variable power divider according to various aspects.

Variable power divider 290 can include mechanical systems to determine the ratio of power distribution to transmission 208 and vacuum generator 232. As shown in FIG. 7, in some aspects, variable power divider 290 (FIG. 6) can include a planetary gear assembly design having a ring gear 297, a planetary carrier 298, and a sun gear 299. With reference to FIGS. 5-7, a gear ratio of the gear assembly can determine the ratio of power distribution to transmission 208 and vacuum generator 232. In some aspects, power can additionally or alternatively be distributed to hydraulic system 218 (FIG. 3). Variable power divider 290 can receive power output 292 from engine 204, where power output 292 is transmitted to ring gear 297.

When variable power divider 290 is not engaged, sun gear 299 can remain idling and rotate in the same direction as power output 292 from engine 204. In this way, nearly all of power output 292 (e.g. approximately 100%) can be transmitted to power input 294 to transmission 208 via ring gear 297 and planetary carrier 298. Power input 294 to transmission 208 can propel vehicle 20 and control the speed of vehicle 20.

When variable power divider 290 is engaged, sun gear 299 can have varying speed to change the gear ratio between sun gear 299 and planetary carrier 298, thus distributing power output 292 between power input 294 to transmission 208 and power input 296 to vacuum generator 232. Throttle 206 (FIG. 8) can control the speed of sun gear 299 and thus the gear ratio, thereby controlling the distribution of power output 292 between power input 294 to transmission 208 and power input 296 to vacuum generator 232. Accordingly, material collection system 100 (FIGS. 1-3) can support power management with a single engine unit.

Figure 8:
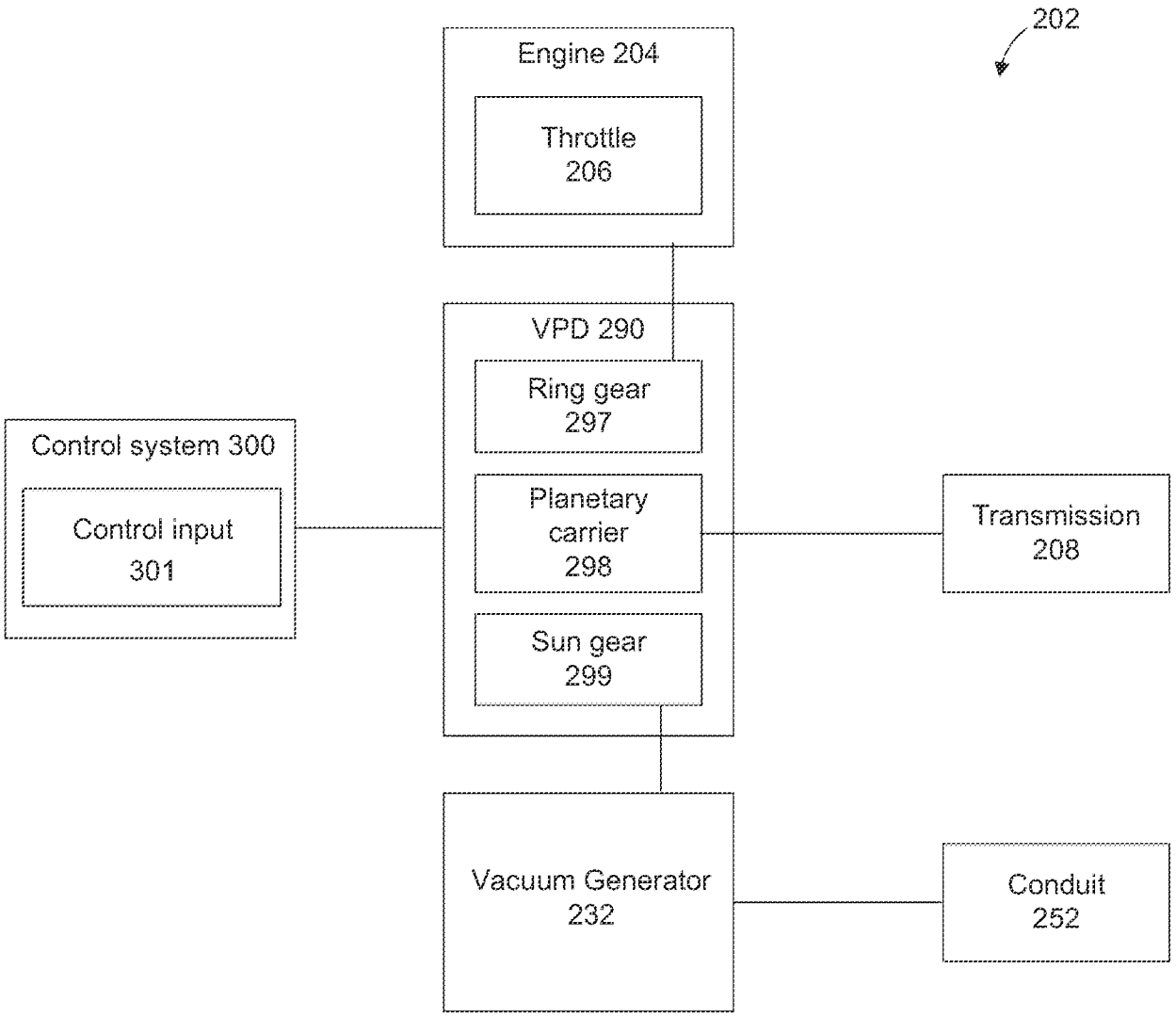
FIG. 8 is a material collection vehicle component schematic according to various aspects.

FIG. 8 illustrates a schematic diagram of a single engine power system 202. Engine 204 can be the only power source to provide the power for the entire material collection system 100 (FIGS. 1-3) as described herein, including vehicle 20 (FIGS. 1-3) and material collection components 10 (FIGS. 1-3). In some aspects, engine 204 can power transmission 208 and vacuum generator 232. Engine 204 can additionally or alternatively provide power to hydraulic system 218 (FIG. 3) to power various actuators and pumps. Power from engine 204 can be transmitted to ring gear 297 of variable power divider 290. In an aspect, planetary carrier 298 can transmit at least a portion of power from engine 204 to transmission 208. In another aspect, sun gear 299 can transmit at least a portion of power from engine 204 to vacuum generator 232 based on engagement of variable power divider. When variable power divider 290 is disengaged, sun gear 299 can be static, and all of the power from engine 204 (e.g. approximately 100%) can be transmitted to transmission 208 via planetary carrier 298. The fan speed of vacuum generator 232 can be minimized at an idle speed (i.e. less than approximately 1200 RPM) or zero speed. When variable power divider 290 is engaged, sun gear 299 can be in motion, changing a gear ratio between sun gear 299 and planetary carrier 298. The gear ratio can determine the amount of the power from engine 204 transmitted to vacuum generator 232, thus changing the fan speed of vacuum generator 232 above the idle speed or zero speed. In this way, power can be distributed between transmission 208 and vacuum generator 232.

In addition, a throttle 206 can be included to receive a throttle input to control a speed of engine 204. In some aspects, material collection system 100 can include a control system 300 to control the engagement of variable power divider 290. In some aspects, throttle 206 can be an operator input to control system 300.

The engagement of variable power divider 290, and therefore the power management, can be controlled based on different conditions of material collection system 100. In some aspects, the control system can control the engagement of variable power divider 290 based on one or more modes. In some aspects, control system 300 can be located in cab 104, as shown in FIG. 3, for example to be accessed by an operator during operation of material collection system 100. Control system 300 can control power distribution between transmission 208 and vacuum generator 232 by switching variable power divider 290 between a first mode (e.g. a travel mode), under which variable power divider 290 is disengaged from vacuum generator 232, and a second mode (e.g. a collection mode), under which variable power divider 290 is engaged with vacuum generator 232. In some aspects, control system 300 can control the engagement of variable power divider 290 based on additional or alternative modes, such as a dump mode, under which variable power divider 290 divides power to hydraulic system 218, such that hydraulic system 218 actuates the movement of boom 270 or the dumping of container 220. In some aspects, vacuum generator 232 can be driven by a variable displacement pump, and in the dump mode, the variable displacement pump can be is adjusted such that fan 233 does not spin during the movement of boom 270 or the dumping of container 220. In some aspects, in the dump mode, the speed of engine 204 can automatically increase to provide more power to hydraulic system 218, such that the movement of boom 270 or the dumping of container 220 can be completed faster.

In some aspects, a control input 301 can be provided by a user to switch between one or more modes, for example between travel mode and collection mode. In this way, a user can toggle the engagement of variable power divider 290. In some aspects, control system 300 can control the engagement of variable power divider 290 without bringing vehicle 20 to a stop and/or engaging a parking brake. In some aspects, under the second mode, the speed of engine 204 and the fan speed of vacuum generator 232 can be relationally controlled by control system 300.

Figure 9:
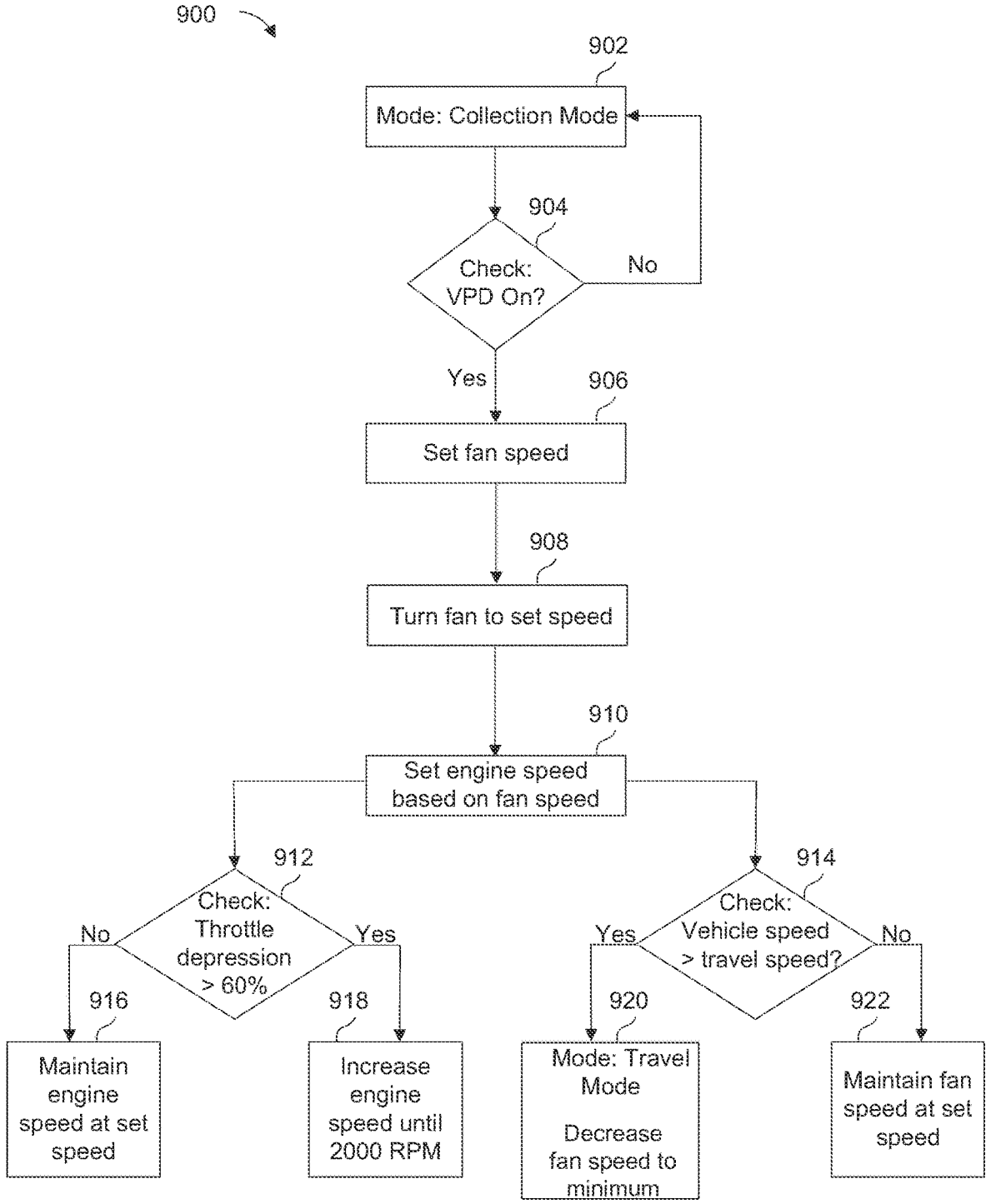
FIG. 9 is a flow chart of an example method for controlling material collection system with a variable power divider according to various aspects.

With reference to FIG. 9, an exemplary control method 900 can include a step 902 of setting variable power divider 290 to the collection mode, e.g., via control input 301 (FIG. 8). In some aspects, method 900 can include a step 904 of determining if variable power divider 290 is engaged. In some aspects, if variable power divider 290 is not engaged, method 900 can repeat steps 902 and 904 until variable power divider 290 is engaged. In some aspects, if variable power divider 290 is engaged, method 900 can include a step 906 of setting fan speed of vacuum generator 232. In some aspects, the fan speed can be input by a user via control input. In some aspects, method 900 can include a step 908 of turning fan speed vacuum generator 232 to the speed set at step 906. In some aspects, at step 910, the speed of engine 204 can be relationally set by control system 300 based on the fan speed of vacuum generator 232.

Exemplary fan speeds of vacuum generator 232 and engine speeds of engine 204 are shown in FIG. 10 in RPM. In an aspect, when the fan speed is set to approximately 0 RPM, the engine speed of engine 204 is set to approximately 1000 RPM or an idle speed. When the fan speed is set to approximately 1200 RPM, the engine speed of engine 204 is set to approximately 1400 RPM. When the fan speed is set to approximately 1600 RPM, the engine speed of engine 204 is set to approximately 1400 RPM. When the fan speed is set to approximately 2000 RPM, the engine speed of engine 204 is set to approximately 1800 RPM. When the fan speed is set to approximately 2400 RPM, the engine speed of engine 204 is set to approximately 2000 RPM. When the fan speed is set to approximately 2600 RPM, the engine speed of engine 204 is set to approximately 2000 RPM. In an aspect, a maximum speed of engine 204 can be greater than 2000 RPM, and a maximum fan speed can be greater than 2600 RPM.

In some aspects, method 900 shown in FIG. 9 can include a step 912 of determining if throttle 206 is engaged more than a threshold, for example, approximately 60%. In some aspects, throttle 206 is engaged more than the threshold when increased engine power is required, such as going up a steep hill or travelling at higher speed while operating vacuum generator 232. Then, in some aspects, at a step 918, control system 300 allows throttle 206 to increase the speed of engine 204 until the maximum speed of engine 204 (e.g. greater than approximately 2000 RPM) is reached. In some aspects, at step 910, fan speed of vacuum generator 232 is maintained at the set speed while the speed of engine 204 increases. In some aspects, throttle 206 is not engaged more than the threshold during normal operation of vacuum generator 232. Then, in some aspects, at a step 916, control system 300 reduces the speed of engine 204 and maintains it at the speed set in step 910 to lower the energy consumption.

In some aspects, method 900 can include a step 914 of determining if the speed of vehicle 20 is greater than a travel speed, such as approximately 5 mph, such as greater than approximately 10 mph, such as greater than approximately 25 mph. The speed of vehicle 20 can be detected by a speed sensor, which can transmit an electronic signal to control system 300. If the speed of vehicle 20 is greater than the travel speed, then at a step 920, control system 300 reduces the fan speed of vacuum generator 232 to a minimum fan speed, such as below approximately 1200 RPM or approximately 0 RPM and switches variable power divider 290 to the travel mode. If the speed of vehicle 20 is not greater than the travel speed, then at a step 922, control system 300 maintains the fan speed of vacuum generator 232 at the speed set in step 908.

Figure 11:
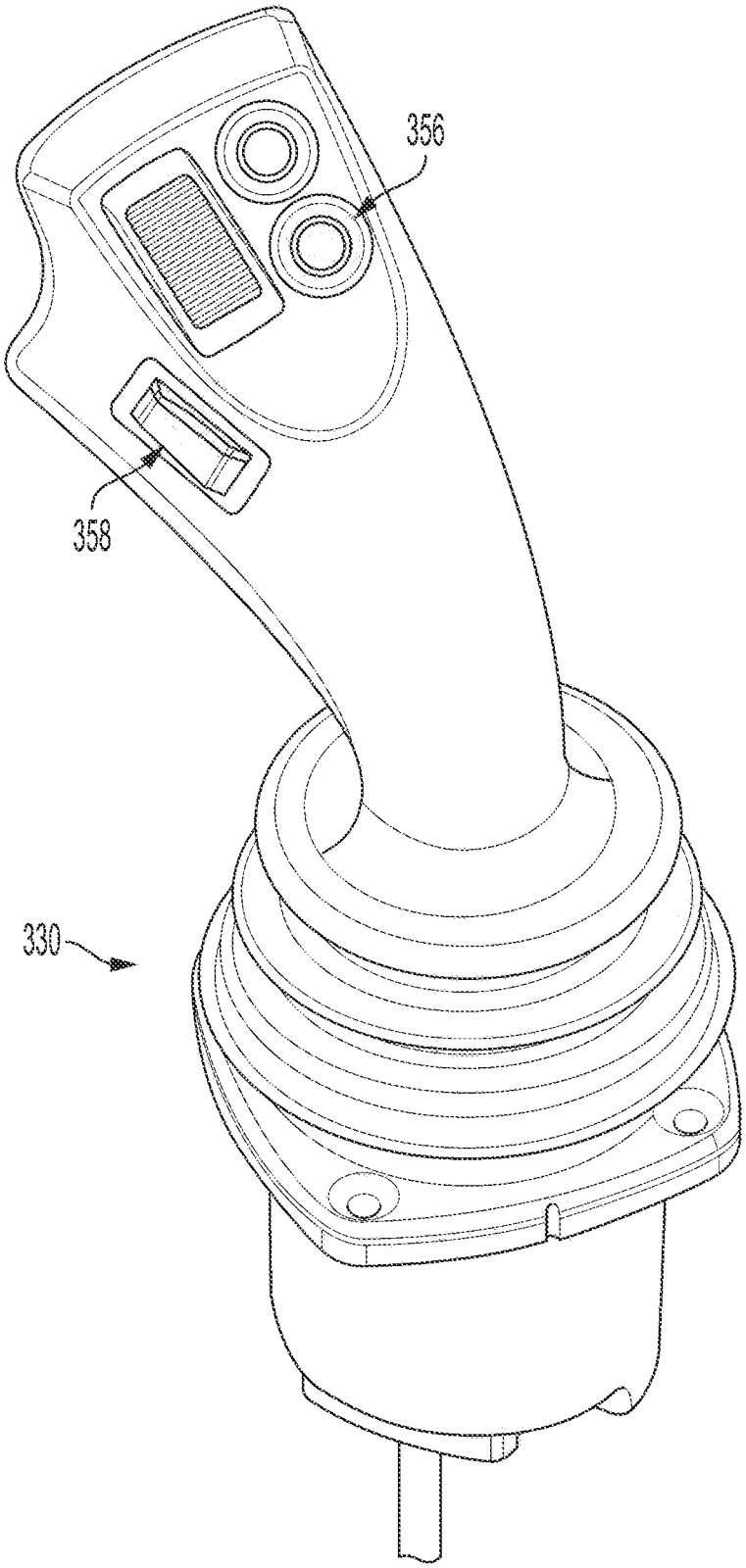
FIG. 11 is a joystick for controlling a material collection system according to various aspects.
Figure 12:
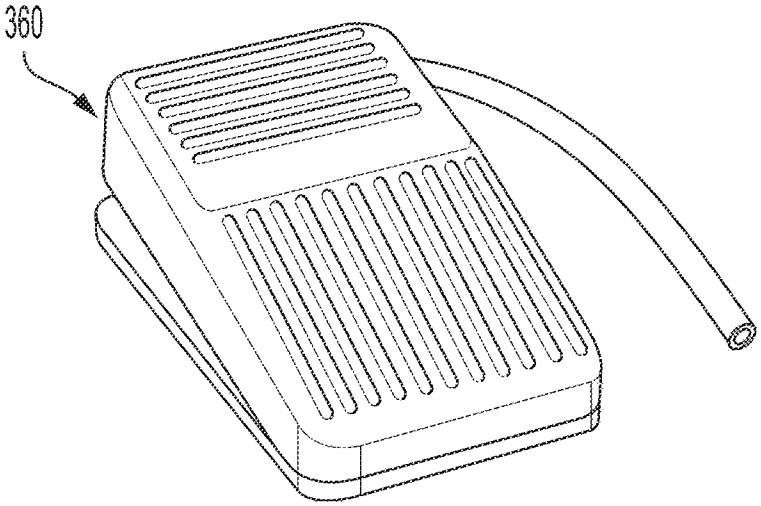
FIG. 12 is a foot pedal for controlling a material collection system according to various aspects.
Figure 13:
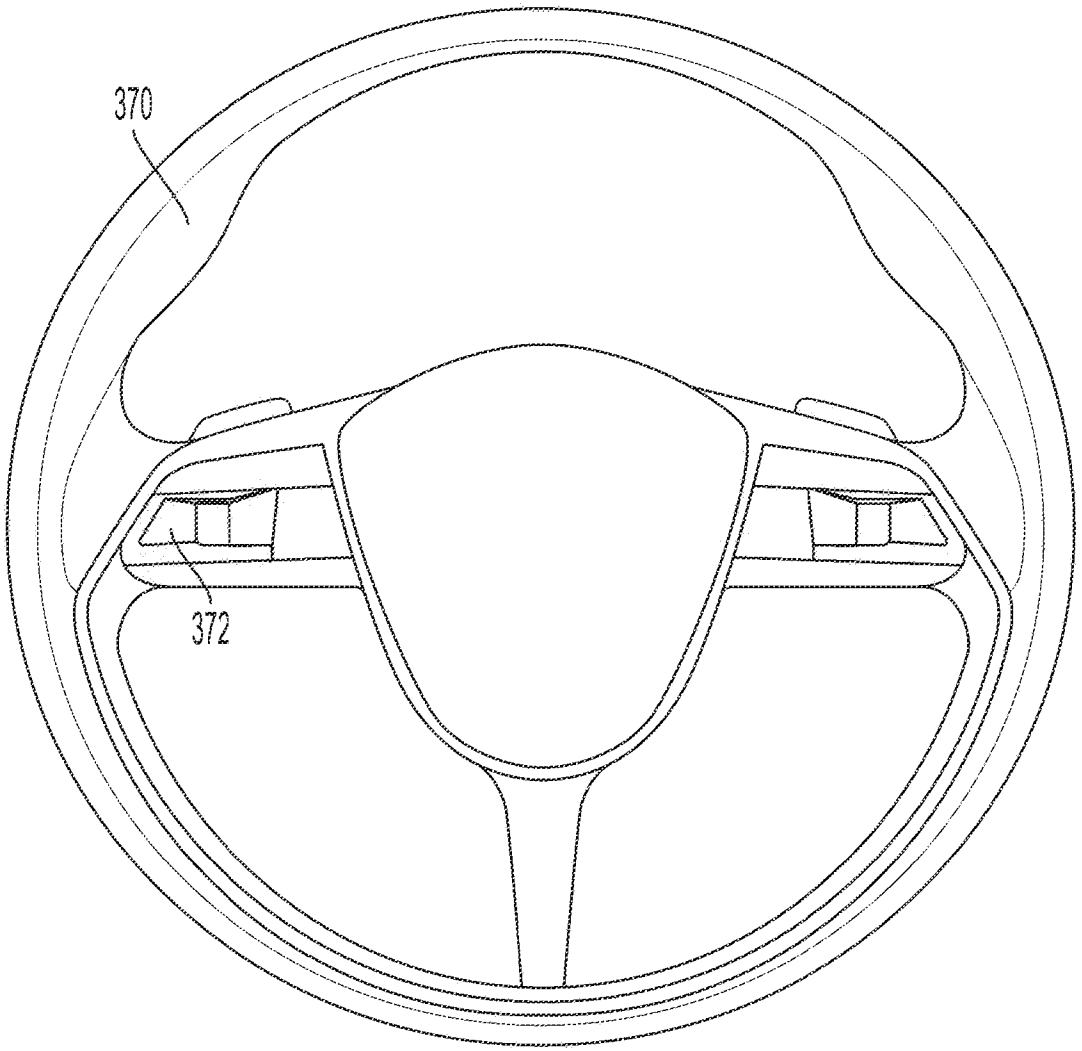
FIG. 13 is a steering wheel for controlling a material collection system according to various aspects.

Control input 301 (FIG. 8) can set variable power divider 290 to a particular mode and/or set the fan speed of vacuum generator 232. Control input 301 can be located in cab 104, as shown in FIG. 3, for example to be accessed by an operator during use of material collection system 100. In some aspects, control input 301 can be provided via buttons 356 on a joystick 330, as shown in FIG. 11. Buttons 356 can allow the user to switch between the travel mode and the collection mode without removing their hand from joystick 330. In some aspects, control input 301 can be provided via a rocker switch 358 on joystick 330. In some aspects, control input 301 can be provided via a foot pedal 360, as shown in FIG. 12. In some aspects, control input 301 can be provided via one or more mode buttons 372 on a steering wheel 370, as shown in FIG. 13. In some aspects, control input 301 can be provided onto a digital display integrated in cab 104 or a portable electronic device (e.g., a dedicated device for material collection system 100 (FIGS. 1-3 or a personal device, such as a smartphone). In some aspects, control input 301 can be provided via a voice command. In some aspects, control input 301 can require authentication such that authorized personnel control engagement of variable power divider 290. For example, a voice command can be authenticated by voice recognition software such that an authorized operator is identified and can control the engagement of variable power divider 290.

Figure 14:
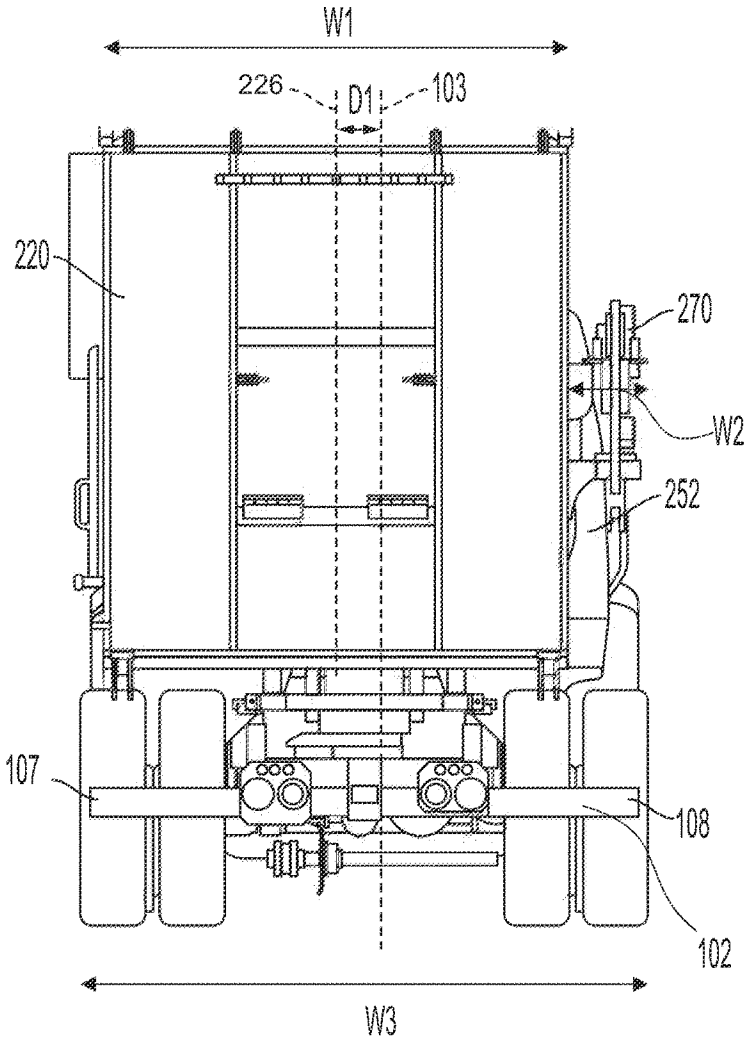
FIG. 14 is a back view of a material collection system according to various aspects.

As discussed herein, power source 202 with a single engine 204 can eliminate the need for auxiliary power source 210. The single engine unit described herein without auxiliary power source 210 can create addition space on chassis 102 to place material collection components 10. In some aspects, with reference to FIG. 14, container 220 can be placed towards a first side 107 of chassis 102 (e.g. a street side). This placement can create extra space on a second and opposing side 108 of chassis 102 (e.g., a curb side).

In some aspects, the size of container 220 can also facilitate creating additional space. In some aspects, container 220 can include a first width W1, which can be in a range of approximately 80 to approximately 90 inches, such as approximately 82 inches to approximately 88 inches, such as approximately 85.5 inches. Container 220 can include a centerline 226 disposed through the center of container 220. Centerline 226 can be offset from a centerline 103 of chassis 102 disposed through the center of chassis 102. In other words, centerline 226 and centerline 103 can lie on different planes. In some aspects, centerline 226 can be offset from centerline 103 towards first side 107 by a distance D1. In some aspects, distance D1 can be in a range of approximately 2 to approximately 8 inches, such as approximately 5 inches. Boom 270 supporting conduit 252 can be stowed in the space created on second side 108, such that boom 270 and conduit 252 do not extend over chassis 102. Boom 270 supporting conduit 252 can form a second width W2, which can be in a range of approximately 30 to approximately 40 inches, such as approximately 32 inches to approximately 38 inches, such as approximately 35.5 inches. Therefore, a total width W3 of material collection system 100 can include first width W1 and second width W2. In some aspects, chassis 102 can form an overall width W3, which can include first width W1 and second width W2. In some aspects, width W3 can be equal to approximately 102 inches. In some aspects, width W3 can be less than approximately 102 inches. In some other aspects, container 220 can be placed offset towards one or more additional sides of chassis 102 to further accommodate boom 270 and conduit 252 and/or accommodate additional or alternative material collection components 10.

Figure 15:
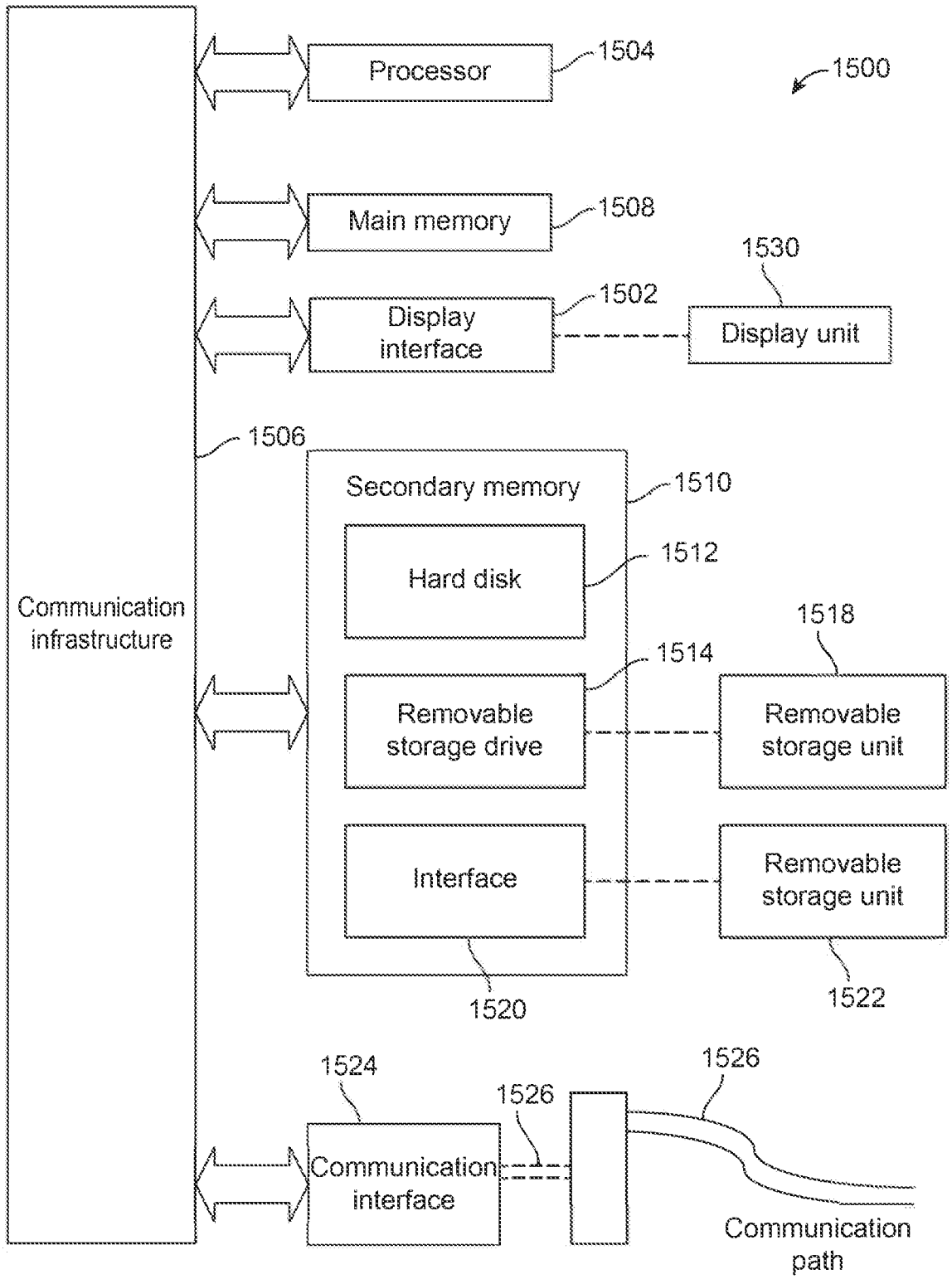
FIG. 15 shows a schematic block diagram of an exemplary computer system in which aspects can be implemented.

With reference to FIG. 15, various aspects of the invention(s) can be implemented in terms of this example computer system 1500. After reading this description, it will become apparent to a person skilled in the relevant art how to implement one or more of the invention(s) using other computer systems and/or computer architectures. Although operations can be described as a sequential process, some of the operations can in fact be performed in parallel, concurrently, and/or in a distributed environment, and with program code stored locally or remotely for access by single or multi-processor machines. In some aspects, edge computing, cloud computing, or a combination thereof can be used. In addition, in some aspects the order of operations can be rearranged without departing from the spirit of the disclosed subject matter.

Processor device 1504 can be a special purpose or a general purpose processor device. As will be appreciated by persons skilled in the relevant art, processor device 1504 can also be a single processor in a multi-core/multiprocessor system, such system operating alone, or in a cluster of computing devices operating in a cluster or server farm. Processor device 1504 can be connected to a communication infrastructure 1506, for example, a bus, message queue, network, or multi-core message-passing scheme.

Computer system 1500 can also include a main memory 1508, for example, random access memory (RAM), and can also include a secondary memory 1510. Secondary memory 1510 can include, for example, a hard disk drive 1512 or a removable storage drive 1514. Removable storage drive 1514 can include a floppy disk drive, a magnetic tape drive, an optical disk drive, a flash memory, or the like. The removable storage drive 1514 can read from and/or write to a removable storage unit 1518 in a well-known manner. Removable storage unit 1518 can include a floppy disk, magnetic tape, optical disk, a universal serial bus (USB) drive, etc. which is read by and written to by removable storage drive 1514. As will be appreciated by persons skilled in the relevant art, removable storage unit 1518 includes a computer usable storage medium having stored therein computer software and/or data.

Computer system 1500 can also optionally include a display interface 1502 (which can include input and output devices such as keyboards, mice, etc.) that forwards graphics, text, and other data from communication infrastructure 1506 (or from a frame buffer not shown) for display on display unit 1530.

In alternative implementations, secondary memory can include other similar means for allowing computer programs or other instructions to be loaded into computer system 1500. Such means can include, for example, a removable storage unit 1522 and an interface 1520. Examples of such means can include a program cartridge and cartridge interface (such as that found in video game devices), a removable memory chip (such as an EPROM, or PROM) and associated socket, and other removable storage units 1522 and interfaces 1520 which allow software and data to be transferred from the removable storage unit 1522 to computer system 1500.

Computer system 1500 can also include a communication interface 1524. Communication interface 1524 allows software and data to be transferred between computer system 1500 and external devices. Communication interface 1524 can include a modem, a network interface (such as an Ethernet card), a communication port, a PCMCIA slot and card, or the like. Software and data transferred via communication interface 1524 can be in the form of signals, which can be electronic, electromagnetic, optical, or other signals capable of being received by communication interface 1524. These signals can be provided to communication interface 1524 via a communication path 1526. Communication path 1526 carries signals and can be implemented using wire or cable, fiber optics, a phone line, a cellular phone link, an RF link, or other communication channels.

In this document, the terms "computer program medium" and "computer usable medium" are used to generally refer to media such as removable storage unit 1518, removable storage unit 1522, and a hard disk installed in hard disk drive 1512. Computer program medium and computer usable medium can also refer to memories, such as main memory 1508 and secondary memory 1510, which can be memory semiconductors (e.g. DRAMs, etc.).

Computer programs (also called computer control logic) are stored in main memory 1508 and/or secondary memory 1510. Computer programs can also be received via communication interface 1524. Such computer programs, when executed, can enable computer system 1500 to implement the aspects as discussed herein. In particular, the computer programs, when executed, enable processor device 1504 to implement the processes of the aspects discussed here. Accordingly, such computer programs represent controllers of the computer system 1500. Where the aspects are implemented using software, the software can be stored in a computer program product and loaded into computer system 1500 using removable storage drive 1514, interface 1520, hard disk drive 1512, or communication interface 1524.

It is to be appreciated that the Detailed Description section, and not the Summary and Abstract sections, is intended to be used to interpret the claims. The Summary and Abstract sections may set forth one or more but not all exemplary aspects of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific aspects will so fully reveal the general nature of the invention that others can, by applying knowledge within the skill of the art, readily modify and/or adapt for various applications such specific aspects, without undue experimentation, without departing from the general concept of the present invention. Therefore, such adaptations and modifications are intended to be within the meaning and range of equivalents of the disclosed aspects, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary aspects, but should be defined only in accordance with the following claims and their equivalents.

What is claimed is:

1. A material collection system, comprising:

a vacuum generator comprising a fan to develop an airflow and draw material into a material inlet of a conduit;

a transmission to control a drive of the material collection system;

a power source to selectively power at least one of the vacuum generator and the transmission;

a variable power divider engaged with the power source and the transmission and selectively engaged with the vacuum generator such that an output from the power source is divided by the variable power divider into a first variable input to the transmission to control a speed of the transmission and a second variable input to the vacuum generator to control a speed of the fan; and a control system to control an output speed of the power source, the first variable input, and the second variable input based on a first mode in which the variable power divider is disengaged from the vacuum generator and a second mode in which the variable power divider is engaged with the vacuum generator, wherein in the second mode, the control system relationally controls the output speed of the power source, the first variable input, and the second variable input based on power needs of the material collection system.

2. The material collection system of claim 1, further comprising:

a boom supporting the conduit, the boom being movable between a stowed position and an operational position, wherein the first mode comprises the boom being in the stowed position.

3. The material collection system of claim 1, wherein approximately all of the output of the power source is transmitted to the first variable input in the first mode.

4. The material collection system of claim 1, wherein at least a portion of the output of the power source is transmitted to the second variable input in the second mode.

5. The material collection system of claim 1, further comprising a throttle to receive a throttle input and control the output of the power source in the first mode and the second mode, wherein the throttle input comprises a threshold, and wherein in the second mode, the throttle controls the output of the power source to a set point when the throttle input is less than the threshold.

6. The material collection system of claim 5, wherein the threshold is approximately 60% engagement of the throttle input.

7. The material collection system of claim 5, wherein the set point is determined based on a speed of the fan.

8. The material collection system of claim 7, wherein the set point is approximately 1400 RPM when the speed of the fan is approximately 1200 RPM to approximately 1600 RPM.

9. The material collection system of claim 7, wherein the set point is approximately 1800 RPM when the speed of the fan is approximately 2000 RPM.

10. The material collection system of claim 7, wherein the set point is an idle speed when the speed of the fan is approximately a minimum speed.

11. The material collection system of claim 5, wherein the throttle controls the output of the power source to a maximum speed when the throttle input is greater than the threshold.

12. The material collection system of claim 11, wherein the maximum speed is approximately 2000 RPM.

13. The material collection system of claim 1, further comprising a control input, wherein the control system controls the first mode and the second mode based on the control input.

14. The material collection system of claim 13, wherein the control input comprises a switch on a joystick.

* * * * *